United States Patent [19]
Nakamura et al.
[11] 4,220,711
[45] Sep. 2, 1980

[54] SILVER HALIDE COLOR PHOTOGRAPHIC LIGHT-SENSITIVE ELEMENT

[75] Inventors: Kotaro Nakamura; Akio Mitsui, both of Minami-ashigara, Japan

[73] Assignees: Fuji Photo Film Co., Ltd., Kanagawa, Japan

[21] Appl. No.: 19,019

[22] Filed: Mar. 8, 1979

[30] Foreign Application Priority Data

Mar. 9, 1978 [JP] Japan ..... 53-26834

[51] Int. Cl.[2] ..... G03C 1/84; G03C 1/40; G03C 1/76

[52] U.S. Cl. ..... 430/507; 430/512; 430/546; 430/551

[58] Field of Search ..... 96/97, 840 V, 56, 74

[56] References Cited

U.S. PATENT DOCUMENTS

| | | | |
|---|---|---|---|
| 3,253,921 | 5/1966 | Sawdey | 96/84 UV |
| 3,533,794 | 10/1970 | Ohi et al. | 96/84 UV |
| 3,676,137 | 7/1972 | Mizuki et al. | 96/56.5 |
| 3,738,837 | 6/1973 | Kuwabara et al. | 96/84 UV |
| 4,009,038 | 2/1977 | Arai et al. | 96/84 UV |

*Primary Examiner*—Richard L. Schilling
*Attorney, Agent, or Firm*—Sughrue, Rothwell, Mion, Zinn and Macpeak; Sughrue, Rothwell, Mion, Zinn and Macpeak

[57] ABSTRACT

A silver halide color photographic light-sensitive element comprising a support having thereon at least one interlayer which comprises a solution prepared by dissolving at least one hydrophobic compound, which acts as an ultraviolet ray-absorbing agent, represented by the following general formula (I) in an alkyl phosphoric acid ester represented by the following general formula (III) dispersed in a gelatin-containing hydrophilic colloid which does not contain any dye image-forming agents, in which element color stain resulting from exposure to light is effectively suppressed:

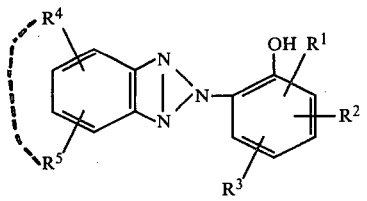

(I)

wherein $R^1$, $R^2$, $R^3$, $R^4$ and $R^5$ may be the same or different, and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, an aralkylthio group, a mono- or dialkylamino group, an acylamino group or a 5- or 6-membered heterocyclic ring containing an oxygen or a nitrogen atom and further, $R^4$ and $R^5$ may combine to form a 5- or a 6-membered aromatic ring consisting of carbon atoms;

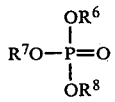

(III)

wherein $R^6$, $R^7$ and $R^8$ each represents a branched chain alkyl group having 8 or more carbon atoms where the total number of carbon atoms contained in compound (III) is 24 to 40.

13 Claims, No Drawings

SILVER HALIDE COLOR PHOTOGRAPHIC LIGHT-SENSITIVE ELEMENT

BACKGROUND OF THE INVENTION

1. Field of the Invention

The present invention relates to a method of preventing color stain from occurring in a color photographic light sensitive element when the sensitive element is exposed to light (such stain is hereafter referred to as "light stain").

2. Description of Prior Art

In general, many of organic compounds contained in a color photographic light sensitive element (including various couplers) are decomposed upon being exposed to light and give rise to a wide variety of colored substances. Such colored substances are responsible for light stain particularly found in areas in which no images are present or images of low density are present. So far, a fair number of techniques have been developed with the intention of preventing the light stain from occurring. For instance, a method for preventing the occurrence of light stain is disclosed in Japanese Patent Publication No. 29620/69, in which hydrophobic 2-(2'-hydroxyphenyl)-benzotriazole compounds are incorporated into a photographic silver halide emulsion layer in order to attain the above-described purpose.

However, in such a method, the addition of 2-(2'-hydroxyphenyl)-benzotriazole in a large quantity causes, contrary to expectations, a reduction in the light stain-preventing effect and even when the maximum light stain-preventing effect is achieved, it is not always satisfactorily high.

Within the scope of this method, various improvements to enhance the light stain-preventing effect have been attempted. For instance, the above-described 2-(2'-hydroxyphenyl)-benzotriazole compound was added to a certain layer not containing any silver halide emulsions, dissolved in one of the high boiling point solvents described in the aforementioned patent specification, however, such modification proved fruitless.

SUMMARY OF THE INVENTION

Therefore, an object of the present invention is to provide a method of suppressing the occurrence of light stain to a greater extent than has been possible conventionally.

Another object of the present invention is to provide a color photographic light sensitive element having light stain reduced to a greater extent than conventional materials.

The above-described objects are attained with a silver halide color photographic light-sensitive element comprising a support having thereon at least one silver halide emulsion layer and at least one layer comprising a solution of at least one hydrophobic compound represented by the general formula (I) dissolved in an alkyl phosphoric acid ester represented by the general formula (III) dispersed in a gelatin-containing hydrophilic colloid in which no dye-forming agents are contained. Hereafter this layer is referred to as the interlayer of the present invention.

DETAILED DESCRIPTION OF THE INVENTION

The hydrophobic compound is a compound of the formula (I)

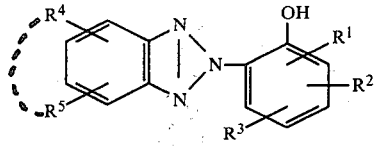

(I)

wherein $R^1$, $R^2$, $R^3$, $R^4$ and $R^5$ may be the same or different and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, an aralkylthio group, a mono or dialkylamino group, an acylamino group, or a 5- or 6-membered heterocyclic ring containing an oxygen or a nitrogen atom and further, $R^4$ and $R^5$ may combine to form a 5- or 6-membered aromatic carbocyclic ring. In the formula (III)

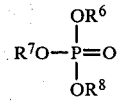

$R^6$, $R^7$ and $R^8$ each represents a branched chain alkyl group having 8 or more carbon atoms where the total number of carbon atoms contained in these three groups is 24 to 40.

The interlayer of the present invention may be provided at any position in a multilayer arrangement of a color photographic light sensitive element, but it is preferred to provide the interlayer of the present invention at a position adjacent to a magenta dye image-forming layer.

Examples of halogen atoms represented by $R^1$, $R^2$, $R^3$, $R^4$ or $R^5$ in the general formula (I) include a chlorine atom, a bromine atom, an iodine atom and a fluorine atom.

The alkyl groups represented by $R^1$, $R^2$, $R^3$, $R^4$ or $R^5$ in the general formula (I) may be straight chain, branched chain or cyclic, substituted or unsubstituted and contain 1 to 30 carbon atoms such as a methyl group, an ethyl group, an n-propyl group, an isopropyl group, an aminopropyl group, an n-butyl group, a sec-butyl group, a tert-butyl group, a chlorobutyl group, an n-amyl group, an iso-amyl group, a hexyl group, an octyl group, a nonyl group, a stearylamindobutyl group, a decyl group, a dodecyl group, a pentadecyl group, a hexadecyl group, a cyclohexyl group, a benzyl group, a phenylethyl group, a phenylpropyl group and the like.

Examples of alkenyl groups represented by $R^1$, $R^2$, $R^3$, $R^4$ or $R^5$ in the general formula (I) include straight chain or branched chain alkenyl groups having 1 to 30 carbon atoms such as a vinyl group, an allyl group, a methallyl group, a dodecenyl group, a tridecenyl group, a tetradecenyl group, an octadecenyl group and the like.

Examples of aryl groups represented by $R^1$, $R^2$, $R^3$, $R^4$ or $R^5$ in the general formula (I) include a mono- or bi-cyclic, substituted or unsubstituted aryl groups having 6 to 32 carbon atoms such as a phenyl group, a 4-methylphenyl group, a 4-ethoxyphenyl group, a 2-hexyloxyphenyl group, a 3-hexyloxyphenyl group and the like.

Examples of alkoxy groups represented by $R^1$, $R^2$, $R^3$, $R^4$ or $R^5$ in the general formula (I) include substituted or unsubstituted alkoxy groups containing 1 to 30 carbon atoms in the alkyl moiety such as methoxy group, an ethoxy group, a propoxy group, a butoxy group, a chlorobutoxy group, a decyloxy group, a diaminophenoxy group, a pentadecyloxy group, an octadecyloxy group and the like.

Examples of acyloxy groups represented by $R^1$, $R^2$, $R^3$, $R^4$ or $R^5$ in the general formula (I) include acyloxy groups derived from aliphatic carboxylic acids and containing 1 to 30 total carbon atoms such as a carbomethoxy group, a carbobutoxy group, a carbohexyloxy group, a carbopentadecyloxy group and the like.

Examples of aryloxy groups represented by $R^1$, $R^2$, $R^3$, $R^4$ or $R^5$ in the general formula (I) include mono- or bi-cyclic aryloxy groups having 6 to 32 carbon atoms such as a phenoxy group, a 4-methylphenoxy group, a 2-propylphenoxy group, a 3-amylphenoxy group and the like.

Examples of alkylthio groups represented by $R^1$, $R^2$, $R^3$, $R^4$ or $R^5$ in the general formula (I) include alkylthio groups having 1 to 30 carbon atoms such as a methylthio group, an ethylthio group, a tert-butylthio group, a tert-octylthio group and the like.

Examples of aralkylthio groups represented by $R^1$, $R^2$, $R^3$, $R^4$ or $R^5$ in the general formula (I) include mono- or bi-cyclic aralkylthio groups having 7 to 30 carbon atoms such as a benzylthio group and the like.

Examples of arylthio groups represented by $R^1$, $R^2$, $R^3$, $R^4$ or $R^5$ in the general formula (I) include substituted and unsubstituted arylthio groups having 6 to 32 carbon atoms such as a phenylthio group a methylphenylthio group, an ethylphenylthio group, a methoxyphenylthio group, an ethoxyphenylthio group, a naphthylthio group and the like.

Examples of mono- or di-alkylamino groups represented by $R^1$, $R^2$, $R^3$, $R^4$ or $R^5$ in the general formula (I) include mono- or di-alkylamino groups having 1 to 30 carbon atoms such as an N-ethylamino group, an N-tert-octylamino group, an N,N-diethylamino group, an N,N-di-tert-butylamino group and the like.

Examples of acylamino groups represented by $R^1$, $R^2$, $R^3$, $R^4$ or $R^5$ in the general formula (I) include acylamino groups having 1 to 30 carbon atoms such as an acetylamino group, a benzoylamino group, a methanesulfonylamino group and the like.

Examples of 5- or 6-membered, oxygen- or nitrogen-containing heterocyclic rings represented by $R^1$, $R^2$, $R^3$, $R^4$ or $R^5$ in the formula (I) include a piperidine group, a morpholine group, a pyrrolioline group, a piperazine group and the like. Examples of 5- or 6-membered carbocyclic rings formed by the combination of $R^4$ and $R^5$ in the general form (I) include a phenyl ring, a cyclohexyl ring and the like.

In the general formula (I), substituents represented by $R^1$ to $R^5$ contain preferably 5 to 36 carbon atoms in the sum total and further, each of alkyl groups represented by some of the substituents desirably contains 1 to 18 carbon atoms.

Of the compounds represented by the general formula (I), compounds represented by the following general formula (II) are particularly useful:

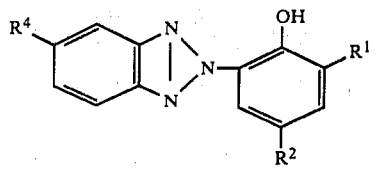

(II)

wherein $R^1$ and $R^2$ each has the same meaning as in the general formula (I); and $R^4$ represents a hydrogen atom, a halogen atom, an alkyl group, an alkoxy group, an aryl group or an aryloxy group, which groups are exemplified as in the general formula (I).

Particularly preferable compounds are those in which $R^4$ is a halogen atom in the general formula (II).

Specific examples of the compounds represented by the above-described general formula are described below. However, the present invention is not intended to be construed as being limited to these examples.

(1) 2-(2'-Hydroxy-5'-tert-butylphenyl)benzotriazole,
(2) 2(2'-Hydroxy-3',5'-di-tert-butylphenyl)benzotriazole,
(3) 2-(2'-Hydroxy-3'-tert-butyl-5'-methylphenyl)-5-chlorobenzotriazole,
(4) 2-(2'-Hydroxy-3',5'-di-tert-butylphenyl)-5-chlorobenzotriazole,
(5) 2-(2'-Hydroxy-5'-isooctylphenyl)benzotriazole,
(6) 2-(2'-Hydroxy-5'-n-octylphenyl)benzotriazole,
(7) 2-(2'-Hydroxy-3',5'-di-tert-amylphenyl)benzotriazole,
(8) 2-(2'-Hydroxy-5'-dodecylphenyl)benzotriazole,
(9) 2-(2'-Hydroxy-5'-hexadecylphenyl)benzotriazole,
(10) 2-(2'-Hydroxy-3'-tert-amyl-5'-phenylphenyl)benzotriazole,
(11) 2-(2'-Hydroxy-3'-tert-amyl-5'-phenylphenyl)benzotriazole,
(12) 5-Methyl-2-(2'-hydroxy-5'-isooctylphenyl)benzotriazole,
(13) 5-Octyl-2-(2'-hydroxy-5'-isooctylphenyl)benzotriazole,
(14) 5-Carbobutoxy-2-(2'-hydroxy-3'-n-butyl-5'-tert-amylphenyl)benzotriazole,
(15) 5-Chloro-2-(2'-hydroxy-3'-n-amyl-5'-phenyl)benzotriazole,
(16) 5-Methoxy-2-(2'-hydroxy-3',5'-di-tert-amylphenyl)benzotriazole,
(17) 5-Nitro-2-(2'-hydroxy-3'-n-octyl-5'-methoxyphenyl)benzotriazole,
(18) 5-Chloro-2-(2'-hydroxy-3'-tert-butyl-5'-cyclohexylphenyl)benzotriazole,
(19) 5-Methyl-2-(2'-hydroxy-3'-chloro-5'-n-octylphenyl)benzotriazole,
(20) 5-Phenyl-2-(2'-hydroxy-3',5'-di-tert-amylphenyl)-benzotriazole,
(21) 5-Methyl-2-(2'-hydroxy-3'-tert-amyl-5'-phenoxyphenyl)benzotriazole,
(22) 2-(2'-Hydroxy-3'-tert-butyl-5'-sec-butylphenyl)-5-chlorobenzotriazole,
(23) 2-(2'-Hydroxy-3'-sec-butyl-5'-tert-butylphenyl)-5-chlorobenzotriazole,
(24) 2-(2'-Hydroxy-5'-chlorophenyl)-5-chlorobenzotriazole,
(25) 2-(2'-Hydroxy-5'-phenylphenyl)-5-chlorobenzotriazole,
(26) 2-(2'-Hydroxy-5'-cyclohexylphenyl)-5-chlorobenzotriazole,
(27) 2-(2'-Hydroxy-4',5'-dichlorophenyl)benzotriazole,

(28) 2-(2'-Hydroxy-3',5'-dichlorophenyl)-5-methoxybenzotriazole,
(29) 2-(2'-Hydroxy-4',5'-dichlorophenyl)-5-methylbenzotriazole,
(30) 2-(2'-Hydroxyphenyl)-5,6-diisopropoxybenzotriazole,
(31) 2-(2'-Hydroxy-5'-methylphenyl)-5,6-diisopropoxybenzotriazole,
(32) 2-(2'-Hydroxyphenyl)-5-methyl-6-dodecyloxybenzotriazole,
(33) 2-(2'-Hydroxyphenyl)-5-methyl-6-isononyloxybenzotriazole,
(34) 2-(2'-Hydroxyphenyl)-5,6-di-n-butoxybenzotriazole,
(35) 2-(2'-Hydroxy-3'-sec-butyl-5'-tert-butylphenyl)-5-methoxybenzotriazole,
(36) 2-(2'-Hydroxy-3',5'-di-sec-butyl-5'-methylphenyl)-benzotriazole,
(37) 2-(2'-Hydroxy-3',5'-di-sec-butylphenyl)-5-chlorobenzotriazole,
(38) 2-(2'-Hydroxy-5'-methylphenyl)-2H-naphthotriazole,
(39) 2-(2'-Hydroxy-5'-ethylphenyl)-2H-(5-chloronaphthotriazole).

The compounds represented by the general formula (I) which may be employed in the present invention can be prepared by the method described in U.S. Pat. No. 3,253,921.

$R^7$ and $R^8$ in the general formula (III) each has preferably 8 to 10 carbon atoms and more preferably, each has 9 carbon atoms.

Specific examples of $R^6$, $R^7$ and $R^8$ each includes

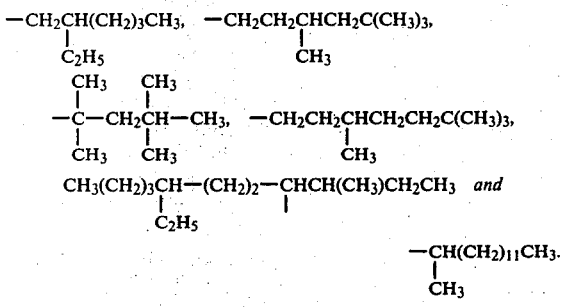

Specific examples of the compounds represented by the general formula (III) which can be preferably used are illustrated below:

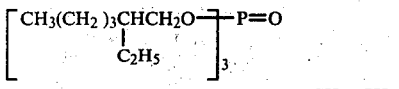
(III-1)

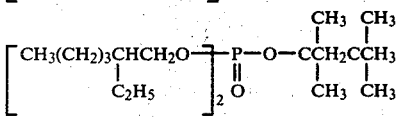
(III-2)

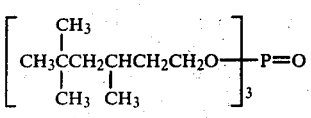
(III-3)

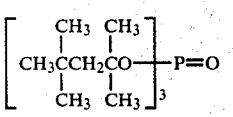
(III-4)

-continued

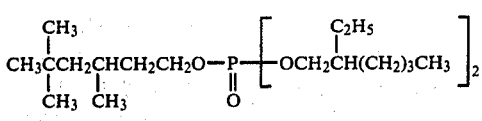
(III-5)

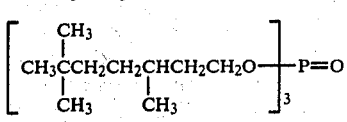
(III-6)

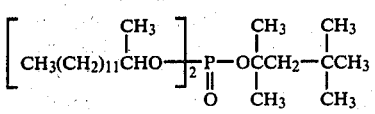
(III-7)

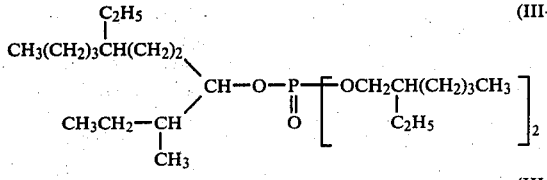
(III-8)

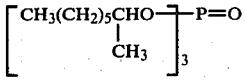
(III-9)

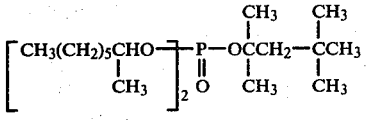
(III-10)

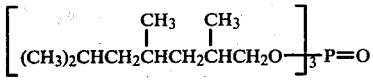
(III-11)

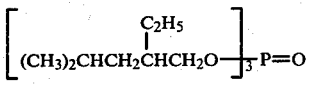
(III-12)

The compounds represented by the general formula (III) which may be employed in the present invention can be prepared by the reaction of phosphorus oxychloride with alcohols, as described in J. R. van Wazer, *Phosphorus and Its Compounds,* volume 2, page 1221, in such a reaction, a base may be used in order to remove hydrogen chloride formed as a by-product. Examples of syntheses of these compounds are illustrated specifically below.

SYNTHESIS EXAMPLE 1

Synthesis of Tri(2-ethylhexyl)phosphate (Compound III-1)

A solution of 429.8 g (3.3 mole) of 2-ethylhexyl alcohol, 237.3 g (3 mole) of pyridine and 500 ml of chloroform was stirred and cooled. Thereto, 153.4 g (1 mole) of phosphorus oxychloride was added dropwise. In order to complete the reaction, the reaction mixture was refluxed for 2 hours as heat was applied thereto. The product obtained was washed thoroughly and successively with water, a dilute aqueous solution of sodium hydroxide, and water, and dried with anhydrous sodium sulfate. The thus obtained solution was filtered and the filtrate was concentrated under reduced pressure and then distilled. Thus, the desired tri(2-ethylhexyl)phosphate was obtained in an amount of 392.9 g (yield: 90.4%). The boiling point was 183°-187° C./1 mmHg.

SYNTHESIS EXAMPLE 2

Synthesis of Tri(3,5,5-trimethylhexyl)phosphate (Compound III-3)

To a solution containing 476.1 g (3.3 mole) of 3,5,5-trimethylhexanol, 237.3 g (3 mole) of pyridine and 600 ml of chloroform 153.4 g (1 mole) of phosphorus oxychloride was added dropwise with stirring and cooling (over 15 minutes). After the completion of the dropwise addition, the reaction mixture was refluxed for 2 hours as heat was applied thereto. The resulting solution was treated in the same manner as in Synthesis Example 1 and then evaporated under reduced pressure. Thus, 411.9 g (yield: 86.4%) of tri(3,5,5-trimethylhexyl)phosphate was obtained as the fraction which distilled at 145°-160° C./$2\times10^{-2}$-$3\times10^{-2}$ mmHg.

A suitable amount of the compound represented by the general formula (I) to be added to the interlayer is about 0.1 to about 6 g/m$^2$ and preferably 0.2 to 1.8 g/m$^2$, and a suitable amount of the compound represented by the general formula (III) to be added to the interlayer is about 0.01 to 1 cc/m$^2$ and preferably 0.1 to 0.5 cc/m$^2$.

In the present invention, the compounds represented by the general formula (I) may be employed individually or in combinations thereof.

The present invention is characterized by the use of the compound represented by the general formula (III) as the solvent for 2-(2'-hydroxyphenyl)-benzotriazole compounds which are ultraviolet ray absorbing agents. An appropriate amount of the compound represented by the formula (I) to be dissolved in the compound represented by the formula (III) is about 0.1 to about 15 g/cc and preferably 1 to 10 g/cc. On the occasion that high boiling point organic solvents cited in U.S. Pat. No. 3,253,921 are used as the solvents for dissolving 2-(2'-hydroxyphenyl)-benzotriazole, the objects of the present invention can not be attained at all even in the case that the ultraviolet ray absorbing agent of the present invention is added to a certain layer not containing any dye-forming agents. On the other hand, the occurrence of the light stain in the color sensitive element can be reduced to a very low level only when the compound represented by the general formula (III) is used as a solvent for the ultraviolet ray absorbing agent employed in the present invention and the solution is added to a layer not containing any dye-forming agents.

Conventional solvents can be used in combination with the compound of the formula (III) to dissolve the compound of formula (I) if desired, however, generally it is preferred to use the compound of formula (III) alone. For example, water immiscible solvents having a high boiling temperature which are described in U.S. Pat. No. 3,253,921 can be used. Suitable amounts of the conventional solvent which can be used in this invention are the same as the amount of the compound represented by the formula (III).

The interlayer of the present invention may contain as a color mixing inhibitor such as a hydroquinone derivative, an aminophenol derivative, a gallic acid derivative, an ascorbic acid derivative or the like. Specific examples of these color mixing inhibitors are described in U.S. Pat. Nos. 2,360,290; 2,336,327; 2,403,721; 2,418,613; 2,675,314; 2,701,197; 2,704,713; 2,728,659; 2,732,300 and 2,735,765: Japanese Patent Applications OPI 92,988/75; 92,989/75; 93,928/75 and 110,337/75: Japanese Patent Publication 23,813/75: and so on. An appropriate addition amount of the color mixing inhibitor ranges from 0.01 g/m$^2$ to 0.5 g/m$^2$.

A suitable amount of gelatin coated in the interlayer is about 0.1 to about 3.0 g/m$^2$, preferably 0.2 to 1.5 g/m$^2$.

The interlayer of the present invention may contain a wide variety of known surface active agents for various purposes. For instance, to use as a coating aid, to increase antistatic effect, to improve slipping property, to facilitate formation of the emulsified dispersion, to prevent adhesion, to improve photographic characteristics (e.g., development acceleration, image contrast, sensitization, etc.) and so on. Specific examples of nonionic surface active agents include saponin (e.g., steroid system), alkyleneoxide derivatives (e.g., polyethylene glycol, polyethylene glycol-polypropylene glycol condensate, polyethylene glycol alkyl or alkylaryl ether, polyethylene glycol esters, polyethylene glycol sorbitan esters, polyalkylene glycol alkylamines or polyalkylene glycol alkylamides, polyethyleneoxide adducts of silicones and the like), glycidol derivatives (such as alkenylsuccinic acid polyglyceride, alkylphenol polyglyceride and the like), fatty acid esters of polyhydric alcohols, alkyl esters of sugar, urethanes or ethers of sugar and so on; anionic surface active agents containing acid groups such as a carboxy group, a sulfo group, a phospho group, a sulfate group, a phosphate group and the like with specific examples including saponins of triterpenoid systems, alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurines, sulfosuccinic acid esters, sulfoalkyl polyoxyethylenealkylphenyl ethers, polyoxyethylene alkylphosphates and the like; amphoteric surface active agents with specific examples including amino acids, aminoalkylsulfonic acids, amonoalkyl sulfates or phosphates, alkylbetaines, amine imides, amine oxides and so on; or cationic surface active agents with specific examples including alkylamine salts, aliphatic or aromatic quaternary ammonium salts, heterocyclic quaternary ammonium salts such as pyridinium, imidazolium and the like, aliphatic or heterocyclic ring-containing phosphonium or sulfonium salts and so on can be employed.

Typical examples of these surface active agents are described in U.S. Pat. Nos. 2,240,472; 2,831,766; 3,158,484; 3,210,191; 3,294,540 and 3,507,660; British Pat. Nos. 1,012,495; 1,022,878; 1,179,290 and 1,198,450; Japanese Patent Application (OPI) No. 117,414/75; U.S. Pat. Nos. 2,739,891; 2,823,123; 3,068,101; 3,415,649; 3,666,478 and 3,756,828; British Pat. No. 1,397,218; U.S. Pat. Nos. 3,133,816; 3,441,413; 3,475,174; 3,545,974; 3,726,683 and 3,843,368; Belgian Pat. No. 731,126; British Pat. Nos. 1,138,514; 1,159,825 and 1,374,780; Japanese Pat. Nos. 378/65; 379/65 and 13,822/68; U.S. Pat. Nos. 2,271,623; 2,288,226; 2,944,900; 3,253,919; 3,671,247; 3,772,021; 3,589,906; 3,666,478 and 3,754,924; Germany Patent Application (OLS) No. 1,961,638; Japanese Patent Application (OPI) No. 59,025/75; and so on.

A hydrophilic colloidal solution for making the interlayer of the present invention may contain water soluble dyes as filter dyes or for various other purposes (it is emphasized, however, that the interlayer does not contain a dye image forming material); for instance, antiirradiation and others. Such dyes include oxonol dyes, hemioxonol dyes, styryl dyes, merocyanine dyes, cyanine dyes and azo dyes. Of these dyes, oxonol dyes, hemioxonol dyes and merocyanine dyes are preferred. Specific examples of dyes employable in the present invention include those which are described in British Patents 584,609 and 1,117,429: Japanese Patent Applications (OPI) Nos. 85,130/73; 99,620/74 and 114,420/74; and U.S. Pat. Nos. 2,274,782; 2,533,472; 2,956,879; 3,148,187; 3,177,078; 3,247,127; 3,540,887; 3,575,704; 3,653,905 and 3,718,472.

In the sensitive element prepared in accordance with the method of the present invention, on the occasion that dyes and ultraviolet ray absorbing agents are incorporated in the hydrophilic colloidal layer(s), they may be mordanted with cationic polymers. For instance, specific polymers described in British Pat. No. 685,475; U.S. Pat. Nos. 2,675,316; 2,839,401; 2,882,156; 3,048,487; 3,184,309 and 3,445,231; Germany Patent Application (OLS) No. 1,914,362; Japanese Patent Applications (OPI) Nos. 47,624/75 and 71,332/75; and so on can be employed.

Photographic emulsion layers of the photographic light sensitive element prepared in accordance with the method of the present invention contain color image forming couplers; that is to say, compounds capable of producing dyes by reacting with oxidation products of aromatic amine (usually primary amine) developing agents. Couplers having hydrophobic non-diffusible groups called ballast groups in their molecules are preferred. The couplers may be four equivalent or two equivalent with respect to the silver ion. Such couplers may include colored couplers possessing color correction effect or couplers releasing development inhibitors with the progress of development (so-called DIR couplers). In addition, the couplers may include such couplers that the products of a coupling reaction may be colorless.

As yellow color-forming couplers, known open chain ketomethylene series couplers can be employed. Of these couplers, benzoylacetoanilide compounds and pivaloylacetoanilide compounds are used to advantage. Specific examples of yellow color-forming couplers employable herein include those which are described in U.S. Pat. Nos. 2,875,057; 3,265,506; 3,408,194; 3,551,155; 3,582,322; 3,725,072 and 3,891,445; German Pat. No. 1,547,868; German Patent Application (OLS) Nos. 2,219,917; 2,261,361 and 2,414,006 British Pat. No. 1,425,020, Japanese Pat. No. 10,783/76; Japanese Patent Application (OPI) Nos. 26,133/72; 73,147/73; 102,636/76; 6,341/75; 123,342/75, 130,442/75; 21,827/76 and 87,650/75: and so on.

As magenta color-forming couplers, pyrazolone compounds indazolone compounds cyanoacetyl compounds and the like can be employed. Of these compounds, pyrazolone compounds are of greater advantage. Specific examples of suitable magenta color forming couplers include those which are described in U.S. Pat. Nos. 2,600,788; 2,983,608; 3,062,653; 3,127,269; 3,311,476; 3,419,391; 3,519,429; 3,558,319; 3,582,322; 3,615,506; 3,834,908 and 3,891,445; German Pat. No. 1,810,464; German Patent Application (OLS) Nos. 2,408,665; 2,417,945; 2,418,959 and 2,424,467; Japanese Pat. Nos. 6,031/65 and 45,990/76; Japanese Patent Application (OPI) Nos. 20,826/76; 58,922/77; 129,538/74; 74,027/74; 159,336/75; 42,121/77; 74,028/74; 60,233/75 and 26,541/76; and so on.

As cyan color-forming couplers, phenol compounds, naphthol compounds and the like can be employed. Specific examples thereof include those which are described in U.S. Pat. Nos. 2,639,929; 2,434,272; 2,474,293; 2,521,908; 2,895,826; 3,034,892; 3,311,476; 3,458,315; 3,476,563; 3,583,971; 3,591,383; 3,767,411 and 4,004,929; German Patent Application (OLS) Nos. 2,414,830 and 2,454,329; and Japanese Patent Application (OPI) Nos. 59,838/73; 26,034/76; 5,055/73 and 146,828/76.

As colored couplers, those which are described in U.S. Pat. Nos. 3,476,560; 2,521,908 and 3,034,892; Japanese Pat. Nos. 2,016/69; 22,335/63; 11,304/67 and 32,461/69; Japanese Patent Application (OPI) No. 26,034/76; and German Patent Application (OLS) No. 2,418,959 can be employed.

As DIR couplers, those which are described in, for example, U.S. Pat. Nos. 3,227,554; 3,617,291; 3,701,783; 3,790,384 and 3,632,345; German Patent Application (OLS) Nos. 2,414,006; 2,454,301 and 2,454,329; British Pat. No. 953,454; Japanese Patent Application (OPI) Nos. 69,624/77 and 122,335/74 and Japanese Pat. No. 16,141/76 can be employed.

Such compounds which release development inhibitors with the progress of a developmental reaction, other than DIR couplers, may be contained in the sensitive element, and they include those which are described in, for example, U.S. Pat. Nos. 3,297,445 and 3,379,529; and German Patent Application (OLS) No. 2,417,914.

As to the above-described couplers, two or more couplers may be contained in the same layer, or the same coupler may be contained in two or more different layers.

Introduction of the couplers into the silver halide emulsion layers can be carried out according to known methods, as described in, for example, U.S. Pat. No. 2,322,027. For instance, the couplers are first dissolved in certain high boiling point organic solvents with specific examples include phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllauryl amide, etc.) and the compounds represented by the general formula (III) of the present invention (e.g., those which are illustrated in the specific examples), or certain low boiling point (b.p. 30°–150° C.) organic solvents with specific examples including lower alkyl acetates such as ethyl acetate, butyl acetate, etc., ethyl propionate, sec-butyl alcohol, methyl isobutyl ketone, $\beta$-ethoxyethyl acetate, methyl cellosolve acetate; and the like and then, the resulting solutions are dispersed into hydrophilic colloids. Therein, the high boiling point organic solvents and the low boiling point organic solvents may be also employed in a mixed form.

On the occasion that a coupler has acid group(s) such as a carboxylic acid group, a sulfonic acid group or the like, the coupler is introduced into a hydrophilic colloid in a form of an alkaline aqueous solution.

These couplers are generally added in amounts of about $2\times10^{-3}$ to $5\times10^{-1}$ mole per mole of silver in the emulsion layer and preferably, in amounts of $1\times10^{-2}$ to $5\times10^{-1}$ mole per mole of silver therein.

In the photographic light-sensitive element prepared in accordance with the method of the present invention, photographic emulsion layers and others are coated on (or over) a commonly used flexible support such as a plastic film, paper, cloth or the like or a commonly used rigid support such as glass, earthenware, metal or the like. Useful examples of flexible supports include films made of semisynthetic or synthetic high polymers, such as cellulose nitrate, cellulose acetate, cellulose acetate butyrate, polystyrene, polyvinyl chloride, polyethylene terephthalate, polycarbonate, etc.; and paper coated or laminated with a baryta layer or an α-olefin polymer (e.g., polyethylene, polypropylene, ethylene-butene copolymer or the like). The support may be colored with a certain dye or a certain pigment. For the purpose of light shielding, the support may be also colored black. The surface of the support is generally subjected to a subbing treatment in order to enhance the adhesion power between the support and a photographic emulsion layer to be provided thereon. Further, the surface of the support may receive a corona discharge, a ultraviolet irradiation, a flame spraying or like treatment.

The effects of the present invention are particularly evident in photographic printing paper, and this effect is particularly remarkable in the case of photographic paper having an opaque support; for instance, baryta layer or α-olefin polymer coated or laminated paper.

EXAMPLE 1

A color photographic light-sensitive element was prepared by coating, on a paper support both sides of which were laminated with polyethylene films, in sequence the first layer (corresponding to the lowest layer) to the sixth layer (corresponding to the topmost layer), as described with respect to their respective functions and compositions in the following Table 3. Each of samples prepared was labeled as shown in Table 1 depending upon the solvent used for dissolving the ultraviolet ray absorbent contained in the fourth layer.

Each of these samples was exposed to light having intensity of 1,000 lux for 1 second by means of a sensitometer, and subjected to processings described in the following Table 4. Each of development-processed samples was exposed to a xenone lamp under such a condition that the intensity of illumination integrated over a period of 10 days was 200,000 lux. Changes of density caused in the white areas of sensitive elements are set forth in the following Table 2.

Table 1

| Sample | Solvent for Ultraviolet Ray Absorbent in the Forth Layer | Remarks |
|---|---|---|
| A | Compound (III-1) | Present Invention |
| B | Compound (III-3) | Present Invention |
| C | Tricresyl Phosphate | Comparison |
| D | Di-n-butyl phthalate | Comparison |

Table 2

Stain Density in White Areas Caused by Illumination Intensity of 200,000 Luxes (Measurements Using Blue Filter).

| Sample | Before Irradiation | After 5 Days' Irradiation | After 10 Days' Irradiation |
|---|---|---|---|
| A | 0.12 | 0.22 | 0.31 |
| B | 0.10 | 0.21 | 0.30 |
| C | 0.11 | 0.25 | 0.39 |
| D | 0.10 | 0.26 | 0.41 |

From the results shown in Table 2 above it can be seen that samples A and B according to this invention showed only a small increase in light stain after prolonged irradiation.

Table 3

| Position | Function | |
|---|---|---|
| 6th Layer | Protective Layer | Gelatin (Coverage: 1,000 mg/m) |
| 5th Layer | Red-sensitive Layer | Silver Chlorobromide Emulsion (Br content: 50 mol %, Coverage: 300 mg silver/$m^2$)<br>Gelatin (Coverage: 1000 mg/$m^2$)<br>Cyan Coupler*1 (Coverage: 400 mg/$m^2$)<br>Coupler Solvent*2 (Coverage: 400 mg/$m^2$) |
| 4th Layer | Inter-layer | Gelatin (Coverage: 1200 mg/$m^2$)<br>Ultraviolet Ray Absorbing Agent *3 (Coverage: 1000 mg/$m^2$)<br>Solvent for Ultraviolet Ray Absorbing Agent (Set forth in Table 1) (Coverage: 250 mg/$m^2$) |
| 3rd Layer | Green-sensitive Layer | Silver Chlorobromide Emulsion (Br Content: 50 mol %, Coverage: 290 mg silver/$m^2$)<br>Gelatin<br>Magenta Coupler*4 (Coverage: 200 mg/$m^2$)<br>Coupler Solvent*5 (Coverage: 200 mg/$m^2$) |
| 2nd Layer | Inter-layer | Gelatin (Coverage: 1000 mg/$m^2$) |
| 1st Layer | Blue-sensitive Layer | Silver Chlorobromide Emulsion (Br Content: 80 mol %, Coverage: 400 mg silver/$m^2$)<br>Gelatin (Coverage: 1200 mg/$m^2$)<br>Yellow Coupler*6 (Coverage: 300 mg/$m^2$)<br>Coupler Solvent*7 (Coverage: 150 mg/$m^2$) |
| Support | | Paper support both sides of which are laminated with polyethylene films |

*1Coupler: 2-[α-(2,4-di-tert-pentylphenoxy)butanamido]-4,6-dichloro-5-methylphenol.
*2Solvent: dibutyl phthalate.
*3Ultraviolet ray absorbing agent 2-(2-hydroxy-3-sec-butyl-5-tert-butylphenyl)benzotriazole.
*4Coupler: 1-(2,4,6-trichlorophenyl)-3-(2-chloro-5-tetra decanamido)anilino-2-pyrazoline-5-one.
*5Solvent: tricresyl phosphate.
*6Coupler: α-pivaloyl-α-(2,4-dioxo-5,5'-dimethyloxazolidine-3-yl)-2-chloro-5-[α-(2,4-di-tert-pentylphenoxy)-butanamido]acetoanilide.
*7Solvent: dioctylbutyl phosphate.

Table 4

| Processings | | |
|---|---|---|
| Color Development | 33° C. | 3 min 30 sec |
| Bleach-Fix | 33° C. | 1 min 30 sec |
| Washing | 30° C. | min |
| Drying | | |

| Color Developing Solution | | |
|---|---|---|
| Benzyl Alcohol | 15 | ml |
| Sodium Sulfite | 5 | g |
| Potassium Bromide | 0.4 | g |
| Hydroxylamine Sulfate | 2 | g |
| 4-(N-ethyl-N-β-methanesulfonamidoethylamino)-2-methylaniline sesquisulfate | 6 | g |
| Sodium Carbonate (Monohydrate) | 20 | g |
| Water to make 1 liter, pH adjusted to 10.1 | | |

| Bleaching-Fixing Agent | | |
|---|---|---|
| Ethylenediaminetetraacetato-iron (III) Complex | 45 | g |
| Sodium Sulfite | 10 | g |
| 70% Aqueous Solution of Ammonium Thiosulfate | 160 | ml |
| Tetrasodium Ethylenediaminetetraacetate | 5 | g |
| Water to make 1 liter, pH adjusted to 6.8 | | |

EXAMPLE 2

Various color photographic light-sensitive element were prepared by coating on a paper support both side of which were laminated with polyethylene films in sequence three layers which were the same as the third layer, the fourth layer and the sixth layer used in Example 1 except that the kind and amount of ultraviolet ray absorbing agent as well as the kind of coupler solvent were changed as shown in Table 5. Depending upon the various kinds of ultraviolet ray absorbing agents and the solvents therefor used in the third and the fourth layers, color sensitive elements prepared were labeled as shown in Table 5.

Table 5

| | The Third Layer | | The Fourth Layer | | |
|---|---|---|---|---|---|
| Sample | Ultraviolet Ray Absorbing Agent | Coupler Solvent | Ultraviolet Ray Absorbing Agent | Solvent for Ultraviolet Ray Absorbing Agent | Remarks |
| E | Compound (23) 0.0025 mol/m$^2$ | Compound (III-3) | not used | not used | Comparison |
| F | not used | Compound (III-3) | Compund (23) 0.0025 mol/m$^2$ | Compound (III-3) | Invention |
| G | Compound (23) 0.0025 mol/m$^2$ | Tricresyl Phosphate | not used | not used | Comparison |
| H | not used | Tricresyl Phosphate | Compound (23) 0.0025 mol/m$^2$ | Tricresyl Phosphate | Comparison |
| J | Compound (23) 0.0025 mol/m$^2$ | Compound (III-1) | not used | not used | Comparison |
| K | not used | Compound (III-1) | Compound (23) 0.0025 mol/m$^2$ | Compound (III-1) | Invention |
| L | Compound (1) 0.0025 mol/m$^2$ | Di-n-butyl (Phthalate | not used | not used | Comparison |
| M | not used | Di-n-butyl Phthalate | Compound (1) 0.0025 mol/m$^2$ | Di-n-butyl Phthalate | Comparison |
| N | not used | Compound (III-3) | Compound (1) 0.0025 mol/m$^2$ | Compound (III-3) | Invention |
| O | not used | Compound (III-6) | Compound (23) 0.0025 mol/m$^2$ | Compound (III-6) | Invention |
| P | not used | Compound (III-1) | Compound (3) 0.0013 mol/m$^2$ Compound (7) 0.0013 mol/m$^2$ | Compound (111-3) | Invention |
| Q | not used | Tricresyl Phosphate | Compound (3) 0.0013 mol/m$^2$ Compound (7) 0.0013 mol/m$^2$ | Compound (III-3) | Invention |

Each of these samples was exposed to light and development-processed in the same manner as in Example 1. Each of the thus obtained samples was exposed to light generated from a xenone lamp with the illumination intensity of 200,000 luxes and the density of the white areas of each sample changed by the stain produced therein, as set forth in Table 6.

Table 6

| (Density of white areas measured through blue filter) | | | |
|---|---|---|---|
| Sample | Before Exposure | After 3 days' Exposure | After 7 days' Exposure |
| E | 0.12 | 0.19 | 0.40 |
| F | 0.11 | 0.16 | 0.20 |
| G | 0.10 | 0.19 | 0.44 |
| H | 0.11 | 0.18 | 0.35 |
| J | 0.11 | 0.18 | 0.41 |
| K | 0.10 | 0.16 | 0.22 |
| L | 0.12 | 0.21 | 0.41 |
| M | 0.10 | 0.19 | 0.36 |
| N | 0.12 | 0.15 | 0.20 |
| O | 0.11 | 0.17 | 0.21 |
| P | 0.11 | 0.15 | 0.21 |
| Q | 0.11 | 0.16 | 0.20 |

From the results shown in Table 6 it can be seen that the samples F, K, N, O, P and Q of the present invention showed considerably small increases in stain after prolonged irradiation.

While the invention has been described in detail and with reference to specific embodiments thereof, it will be apparent to one skilled in the art that various changes and modifications can be made therein without departing from the spirit and scope thereof.

We claim:

1. A silver halide color photographic light sensitive element comprising a support having thereon at least one interlayer which comprises a soluton prepared by dissolving at least one hydrophobic compound represented by the following general formula (I) in an alkyl phosphoric acid ester represented by the following general fomula (III) dispersed in a gelatin containing hydrophilic colloid, said interlayer not containing any dye image forming agents; and having thereon at least two silver halide emulsion layers containing different color-forming couplers selected from the group of silver halide emulsion layers consisting of a green-sensitive silver halide emulsion layer containing a magenta color-forming coupler, a blue-sensitive silver halide emulsion layer containing a yellow color-forming coupler, and a red-sensitive silver halide emulsion layer containing a cyan color-forming coupler and having between at least one pair of successive silver halide emulsion layers an interlayer as described above:

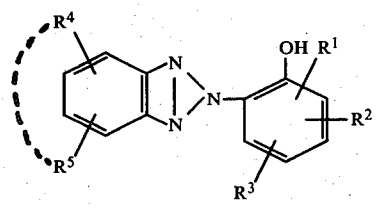

(I)

wherein $R^1$, $R^2$, $R^3$, $R^4$ and $R^5$ may be the same or different and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, an aralkylthio group, a mono- or a di-alkylamino group, an acylamino group or a 5- or a 6-membered heterocyclic ring containing an oxygen or a nitrogen atom and further, $R^4$ and $R^5$ may be combined to form a 5- or a 6-membered aromatic ring consisting of carbon atoms;

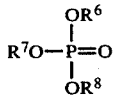

(III)

wherein $R^6$, $R^7$ and $R^8$ each represents a branched chain alkyl group having 8 or more carbon atoms, where the total number of carbon atoms contained in these three groups is about 24 to 40.

2. The silver halide color photographic light sensitive element of claim 1 wherein said hydrophobic compound is represented by the following general formula (II):

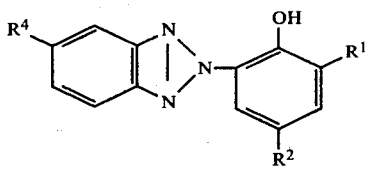

(II)

wherein $R^1$ and $R^2$ each has the same meaning as in the general formula (I), and $R^4$ represents a hydrogen atom, a halogen atom, an alkyl group, an alkoxy group, an aryl group or an aryloxy group.

3. The silver halide color photographic light sensitive element of claim 1 wherein said interlayer is provided adjacent to and on the side opposite to the support of a green-sensitive silver halide emulsion layer.

4. The silver halide color photographic light sensitive element of claim 1 where said interlayer is provided adjacent to both sides of a green-sensitive silver halide emulsion layer and in which the support is opaque.

5. The silver halide color photographic light sensitive element of claim 4 wherein said opaque support is paper having a baryta layer or paper coated with an $\alpha$-olefin polymer or laminated with a film thereof.

6. The silver halide color photographic light sensitive element of claim 1 wherein said interlayer containing the compound represented by the general formula (III) additionally contains a hydroquinone derivative, an aminophenol derivative, a gallic acid derivative of an ascorbic acid derivative.

7. The silver halide color photographic light sensitive element of claim 1 wherein the $R^6$, $R^7$ and $R^8$ each contains 8 to 10 carbon atoms.

8. The silver halide color photographic light sensitive element of claim 1, wherein said compound of the formula (I) is present in said interlayer in an amount of about 0.2 to 1.8 g/m$^2$.

9. The silver halide color photographic light sensitive element of claim 1, wherein said alkyl phosphoric acid ester is present in said interlayer in an amount of about 0.1 to 0.5 cc/m$^2$.

10. The silver halide color photographic light sensitive element of claim 1, wherein said interlayer additionally contains a color mixing inhibitor.

11. The silver halide color photographic light sensitive element of claim 1, wherein said interlayer additionally contains a surface active agent.

12. The silver halide color photographic light sensitive element of claim 1, wherein said element contains a green-sensitive silver halide emulsion layer containing a magenta color-forming coupler, a blue-sensitive silver halide emulsion layer containing a yellow color-forming coupler, and a red-sensitive silver halide emulsion layer containing a cyan color-forming coupler.

13. An element according to claim 12, which contains an interlayer between each two successive silver halide emulsion layers.

* * * * *